US011632834B2

(12) United States Patent
Wang et al.

(10) Patent No.: US 11,632,834 B2
(45) Date of Patent: Apr. 18, 2023

(54) SERIAL LED DRIVER WITH BUILT-IN CALIBRATABLE PARAMETER AND LED SYSTEM USING THE SAME

(71) Applicant: Weida Hi-tech Corporation Ltd., Hsinchu (TW)

(72) Inventors: Jen-Chuan Wang, Hsinchu (TW); Zhao-Yi Lin, Hsinchu (TW); Zi-Huan Luo, Taoyuan (TW)

(73) Assignee: WEIDA HI-TECH CORPORATION LTD., Hsinchu (TW)

( * ) Notice: Subject to any disclaimer, the term of this patent is extended or adjusted under 35 U.S.C. 154(b) by 0 days.

(21) Appl. No.: 17/376,761

(22) Filed: Jul. 15, 2021

(65) Prior Publication Data

US 2023/0026213 A1 Jan. 26, 2023

(51) Int. Cl.
*H05B 45/14* (2020.01)
*H05B 45/325* (2020.01)

(52) U.S. Cl.
CPC ..... *H05B 45/14* (2020.01); *H05B 45/325* (2020.01)

(58) Field of Classification Search
CPC ..... H05B 45/14; H05B 45/36; H05B 45/46; H05B 45/56; H05B 45/3725; H05B 45/395; H05B 45/225; H05B 47/14; H05B 47/23
See application file for complete search history.

(56) References Cited

U.S. PATENT DOCUMENTS 9,622,326 B1 * 4/2017 Devyver ..... G09G 3/3406
9,649,974 B1 * 5/2017 Arumugasamy ..... B60Q 1/143
11,056,029 B1 7/2021 Wang

FOREIGN PATENT DOCUMENTS

KR 20180049270 A * 5/2018 ..... H05B 45/24
TW M368010 U 11/2009

* cited by examiner

*Primary Examiner* — Abdullah A Riyami
*Assistant Examiner* — Syed M Kaiser
(74) *Attorney, Agent, or Firm* — Muncy, Geissler, Olds & Lowe, P.C.

(57) ABSTRACT

A serial LED driver with a built-in calibratable parameter transmits a grayscale vector, a calibration parameter matrix or an appropriate current value vector and includes: a nonvolatile memory receiving and storing the calibratable parameter; a calibration matrix processing unit reads elements corresponding to the LED lamp bead and being pre-stored in the calibration parameter matrix of the nonvolatile memory, receives the grayscale vector, and performs matrix computation according to the grayscale vector and the calibration parameter matrix to generate a new grayscale vector; and a pulse width modulation circuit, which outputs a constant current to the LED lamp bead according to the first new grayscale vector to adjust the LED lamp bead; or outputs another corresponding constant current to adjust the LED lamp bead according to the new grayscale vector and the appropriate current value vector corresponding to the LED lamp bead and being pre-stored in the nonvolatile memory.

13 Claims, 9 Drawing Sheets

SERIAL LED DRIVER WITH BUILT-IN CALIBRATABLE PARAMETER AND LED SYSTEM USING THE SAME

BACKGROUND OF THE INVENTION

Field of the Invention

This disclosure relates to a light-emitting diode (LED) device, and more particularly to a serial LED driver with a built-in calibratable parameter and a LED system using the same.

Description of the Related Art

At present, the LED packaging factory screens the LEDs with similar properties into several bins in order to satisfy light-emitting ranges that can be used by customers, so that the same bin of LEDs can satisfy the required light-emitting range.

However, even though the LED packaging factory has screened the LEDs with the similar properties, the brightness values of the same bin of LED lamp beads still have ±10% of errors. So, the qualities of the assembled LED systems still cannot satisfy the high-quality requirements of the customers.

BRIEF SUMMARY OF THE INVENTION

It is therefore an objective of this disclosure to provide a LED driver having a nonvolatile memory for storing calibratable parameters for calibrating LED lamp beads.

According to another objective of this disclosure, computation is performed according to an input grayscale received by the LED driver and the calibratable parameter stored in the nonvolatile memory, so that the color of the LED lamp bead reaches the more precisely predefined value.

According to still another objective of this disclosure, the precision error of the brightness of the LED lamp bead is lower than (<) ±2%, so that the quality of the LED lamp bead is increased.

According to yet still another objective of this disclosure, a light-emitting range of the LED lamp bead can be selectively shifted to decrease inventory requirements on different bin levels of LED lamp beads, to achieve the flexible production allocation, to increase the production applicability and to increase the value.

This disclosure provides a serial LED driver with a built-in calibratable parameter. The serial LED driver transmits a grayscale vector, a calibration parameter matrix or an appropriate current value vector and includes: a nonvolatile memory receiving and storing the calibratable parameter corresponding to a LED lamp bead for calibration of the LED lamp bead; a calibration matrix processing unit, which reads elements of the calibration parameter matrix corresponding to the LED lamp bead and being pre-stored in the nonvolatile memory, receives the grayscale vector, and performs matrix computation according to the grayscale vector and the calibration parameter matrix to generate a first new grayscale vector; and a pulse width modulation circuit, which outputs a constant current to the LED lamp bead according to the first new grayscale vector to adjust the LED lamp bead; or outputs another corresponding constant current to the LED lamp bead to adjust the LED lamp bead according to the first new grayscale vector and the appropriate current value vector corresponding to the LED lamp bead and being pre-stored in the nonvolatile memory.

In an embodiment of this disclosure, the LED lamp bead has a corresponding bin level. When an original bin level is adjusted to a new bin level, the calibration matrix processing unit receives a new calibration parameter matrix, and the calibration matrix processing unit performs matrix multiplication of the grayscale vector and the new calibration parameter matrix to generate a second new grayscale vector.

In an embodiment of this disclosure, the calibratable parameter includes a RGB grayscale component corresponding to the LED lamp bead; or a RGB grayscale component corresponding to the LED lamp bead and the appropriate current value vector of RGB.

This disclosure further provides a LED display system having a serial LED driver with a built-in calibratable parameter. The LED display system includes: a microcontroller unit transmitting a grayscale vector, a calibration parameter matrix or an appropriate current value vector; multiple serial LED drivers arranged in an array, wherein each of the serial LED drivers includes: a LED lamp bead; a nonvolatile memory receiving and storing the calibratable parameter corresponding to the LED lamp bead for calibration of the LED lamp bead; a calibration matrix processing unit, which reads elements of the calibration parameter matrix corresponding to the LED lamp bead and being pre-stored in the nonvolatile memory, receives the grayscale vector, and performs matrix computation according to the grayscale vector and the calibration parameter matrix to generate a first new grayscale vector; and a pulse width modulation circuit, which outputs a constant current to the LED lamp bead according to the first new grayscale vector to adjust the LED lamp bead; or outputs another corresponding constant current to the LED lamp bead to adjust the LED lamp bead according to the first new grayscale vector and the appropriate current value vector corresponding to the LED lamp bead and being pre-stored in the nonvolatile memory.

DETAILED DESCRIPTION OF THE INVENTION

Figure 1A:
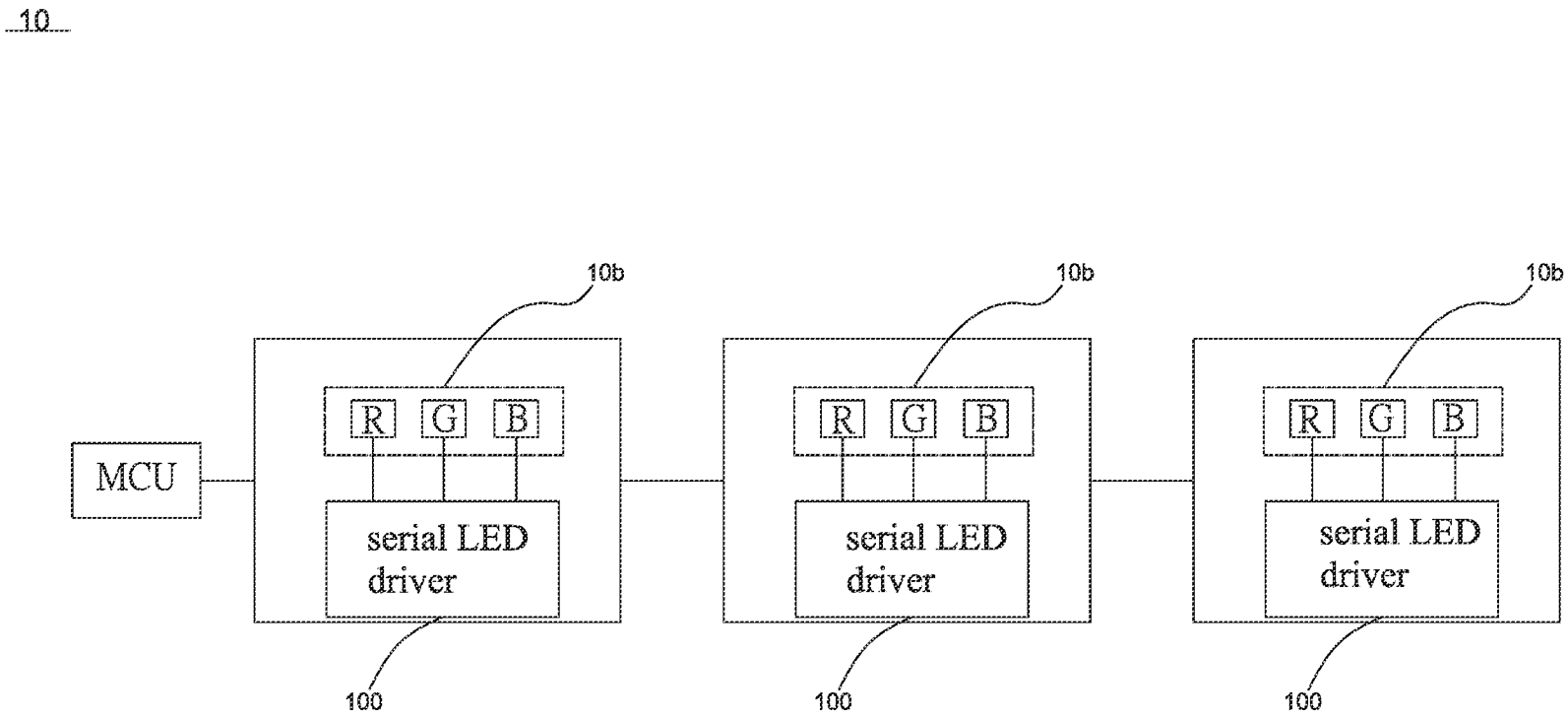
FIG. 1A is a schematic view showing a LED display system according to an embodiment of this disclosure.

FIG. 1A is a schematic view showing a LED display system 10 according to an embodiment of this disclosure. Referring to FIG. 1A, the LED display system 10 includes a microcontroller unit MCU, multiple serial LED drivers 100 and lamp beads 10*b*. Please note that a single-ended serial link is disposed between the LED drivers 100. That is, a single-ended serial connection is present between adjacent LED drivers 100. The microcontroller unit MCU transmits a grayscale vector and a calibration parameter matrix through a single-ended signal.

Figure 1B:
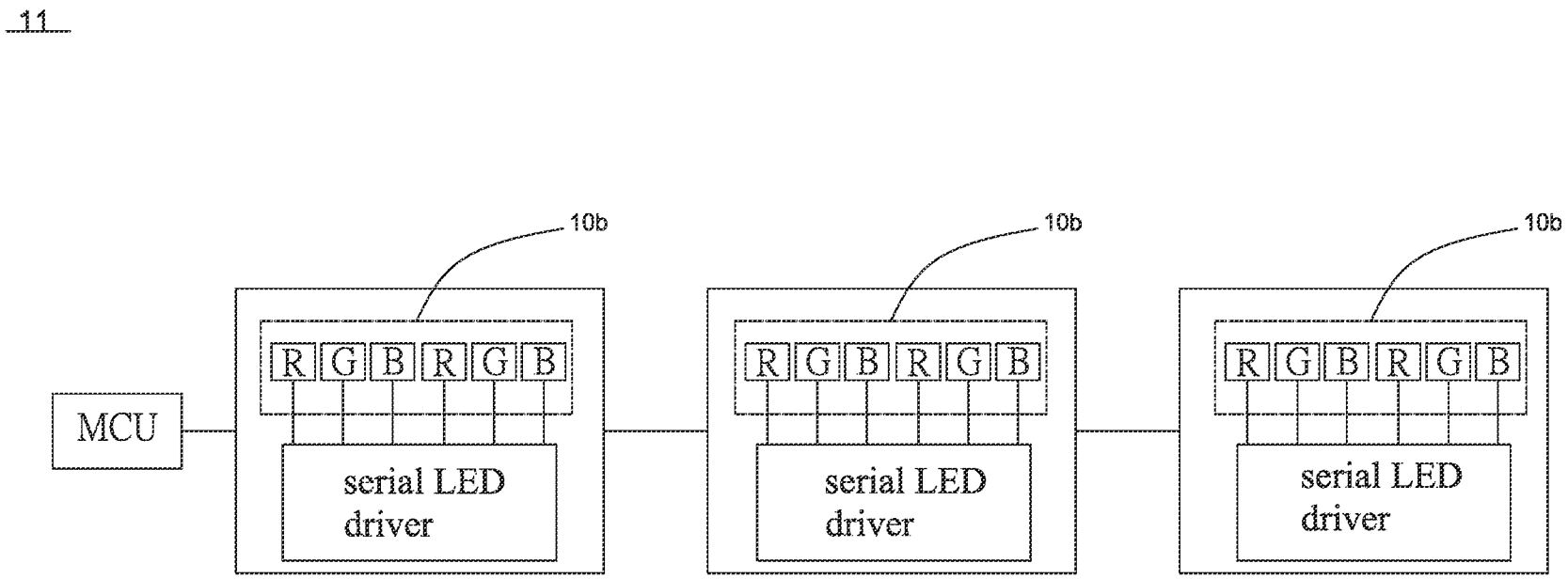
FIG. 1B is a schematic view showing a LED display system according to an embodiment of this disclosure.

Although FIG. 1A depicts that each serial LED driver in the LED display system 10 has the architecture of one pixel of lamp bead 10*b*, but this disclosure should not be restricted thereto. As shown in FIG. 1B, a LED display system 11 may also have the architecture of two pixels of lamp beads 10*b*. That is, each serial LED driver may include multiple pixels of lamp beads 10*b*.

Figure 2A:
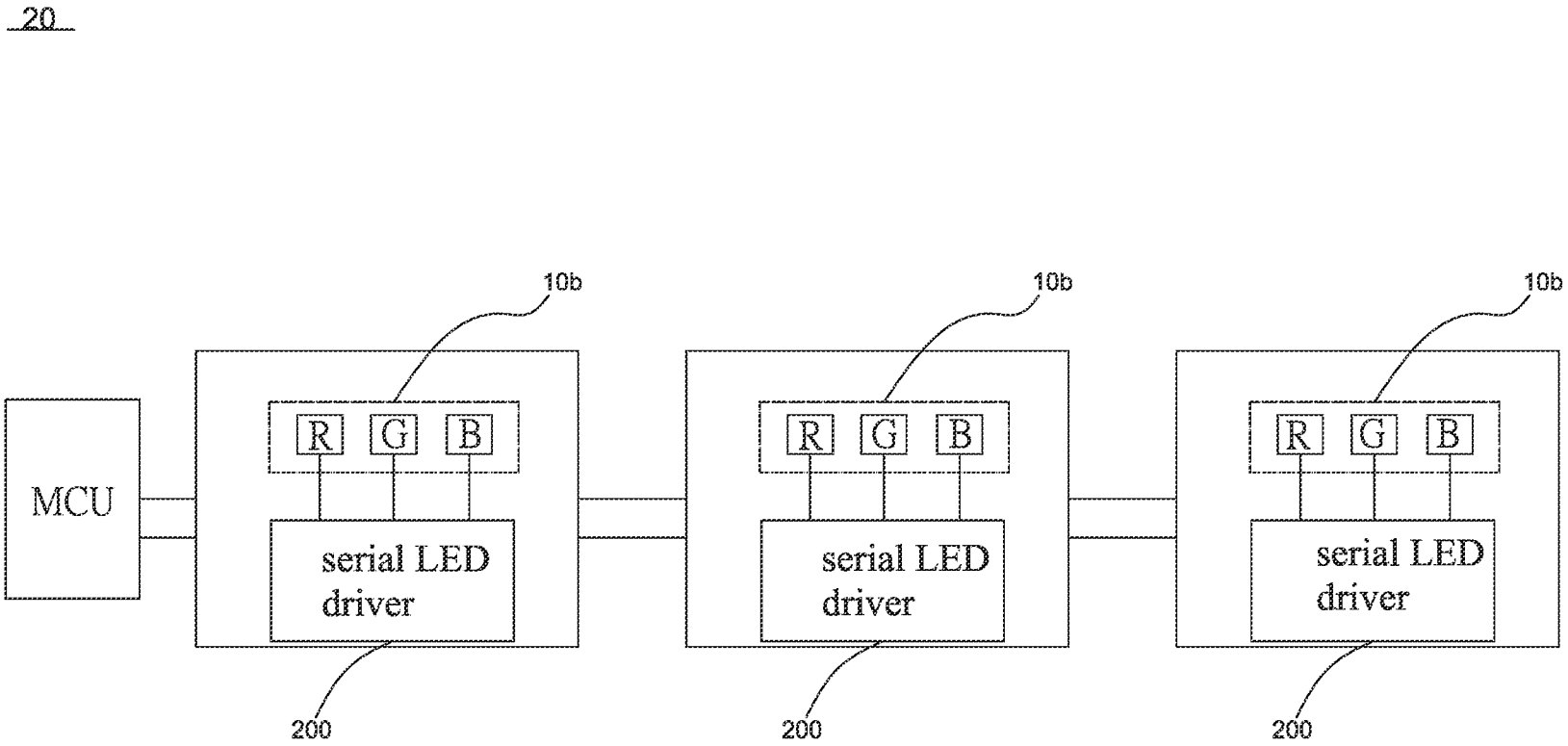
FIG. 2A is a schematic view showing a LED display system according to an embodiment of this disclosure.

FIG. 2A is a schematic view showing a LED display system 20 according to an embodiment of this disclosure. Referring to FIG. 2A, the LED display system 20 includes a microcontroller unit MCU, multiple serial LED drivers 200 and a lamp bead 10*b*. Please note that a differential serial link is present between the LED drivers 200, and that the microcontroller unit MCU transmits the grayscale vector, the calibration parameter matrix or the appropriate current value vector through a differential signal. The microcontroller unit MCU may also transmit the grayscale vector, the calibration parameter matrix or the appropriate current value vector to a first LED driver 200 through a single-ended signal, and the differential signal transmission is performed between the first LED driver 200 and other LED drivers 200.

Figure 2B:
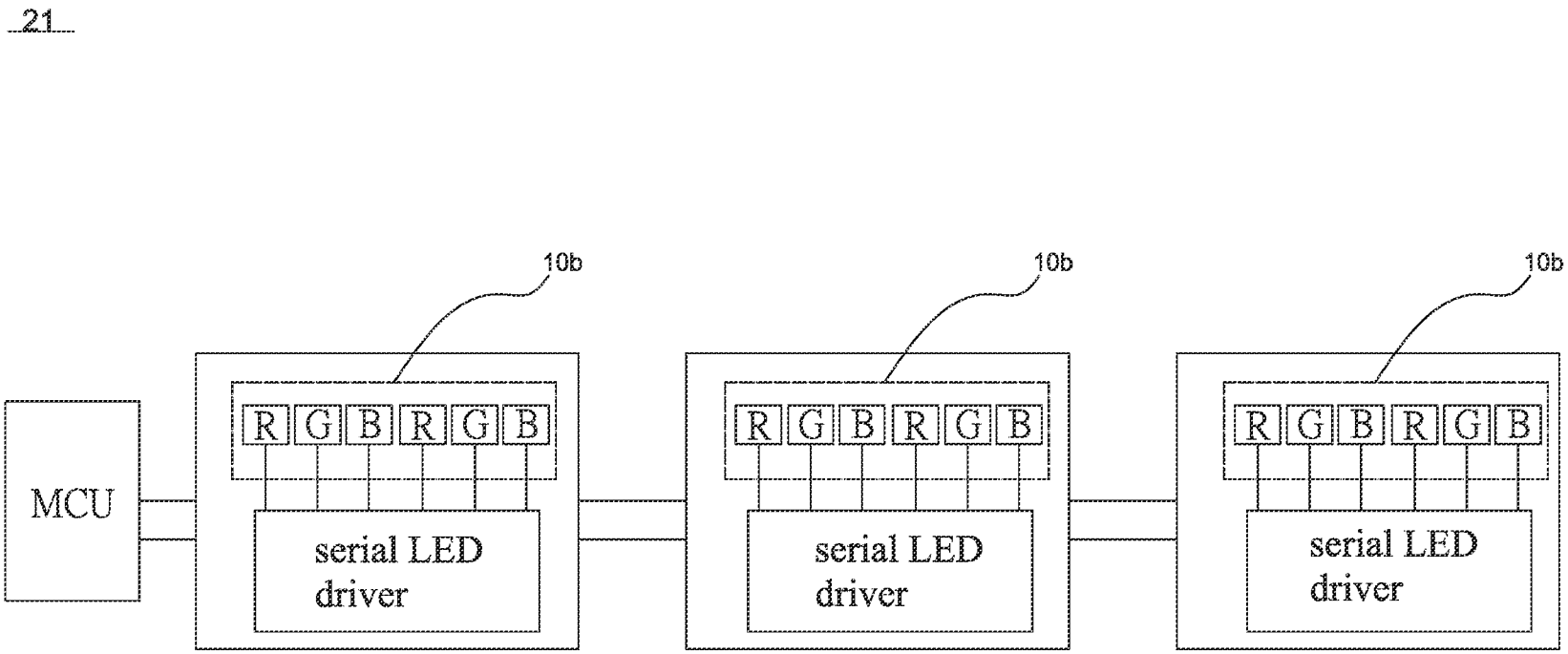
FIG. 2B is a schematic view showing a LED display system according to an embodiment of this disclosure.

Although FIG. 2A depicts that each serial LED driver in the LED display system 10 has the architecture of one pixel of lamp bead 10*b*, but this disclosure should not be restricted thereto. As shown in FIG. 2B, a LED display system 21 may also have the architecture of two pixels of lamp beads 10*b*. That is, each serial LED driver may include multiple pixels of lamp beads 10*b*.

Figure 3:
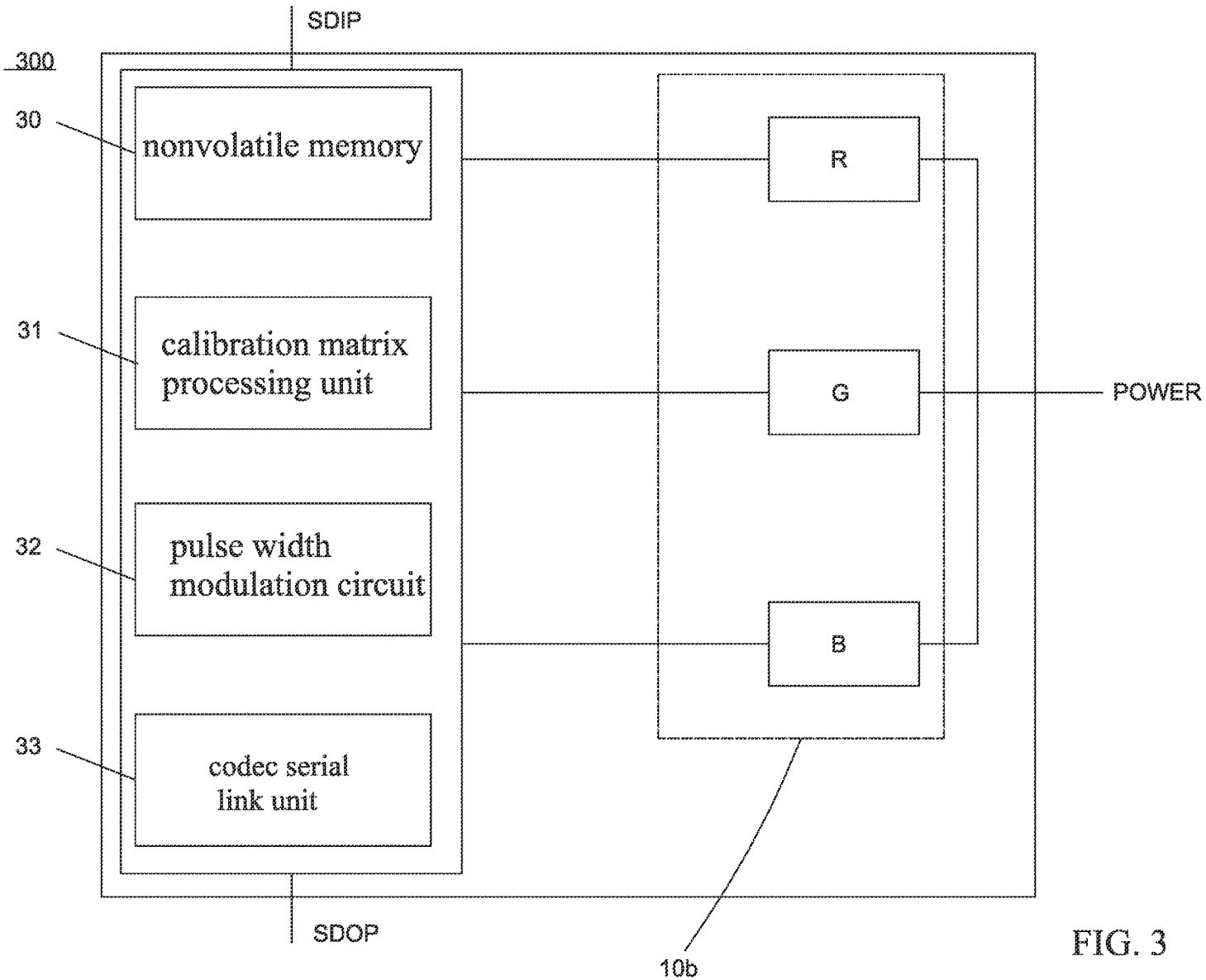
FIG. 3 is a schematic view showing a serial LED driver according to an embodiment of this disclosure.

FIG. 3 is a schematic view showing a serial LED driver 300 according to an embodiment of this disclosure. Referring to FIG. 3, the serial LED driver 300 includes a nonvolatile memory 30, a calibration matrix processing unit 31, a pulse width modulation circuit 32, a codec serial link unit 33 and lamp beads 10*b*. The serial LED driver 300 has a serial link data input interface SDIP and a serial link data output interface SDOP for bidirectionally transmitting data. For example, as shown in FIG. 1A, the microcontroller unit MCU can transmit commands and write data, and can also read data from other serial LED drivers 300. That is, the serial LED driver 300 and the lamp bead 10*b* may be in the open/short-circuit state, for example. In addition, a voltage source POWER represents an input voltage.

The calibration matrix processing unit 31 reads all matrix elements of the calibration parameter matrix corresponding to the lamp bead and being pre-stored in the nonvolatile memory 30, receives the grayscale vector, and performs matrix computation to generate a first new grayscale vector according to the grayscale vector and the calibration parameter matrix.

The pulse width modulation circuit 32 is coupled to the calibration matrix processing unit 31, and outputs a constant current to the LED lamp bead 10*b* according to the first grayscale vector to adjust the grayscale or brightness of the LED lamp bead 10*b*.

In another embodiment, the nonvolatile memory 30 pre-stores the appropriate current value vector corresponding to the LED lamp bead 10*b*, and the pulse width modulation circuit 32 outputs another corresponding constant current to the LED lamp bead 10*b* to adjust the LED lamp bead 10*b* according to the appropriate current value vector pre-stored in the nonvolatile memory 30 and the first new grayscale vector.

In a pre-calibration embodiment (not shown), when the error of the color precision of the LED lamp bead 10*b* is smaller than ±2%, the calibration matrix processing unit 31 stops the computation of pre-calibrating the grayscale vector and the calibration parameter matrix. At this time, the nonvolatile memory 30 stores all matrix elements of the calibration parameter matrix corresponding to the LED lamp bead 10*b* as the calibratable parameter.

Finally, the codec serial link unit 33 encodes the grayscale vector, the calibration parameter matrix or the appropriate current value vector into encoded data transmitted to another serial LED driver 300 through the serial link data output interface SDOP, or decodes encoded data, received from another serial LED driver 300 through the serial link data input interface SDIP, into the grayscale matrix or the calibration parameter matrix transmitted to the calibration matrix processing unit 31. In one embodiment, the codec serial link unit 33 decodes encoded data, received from another serial LED driver 300 into the appropriate current value vector transmitted to the pulse width modulation circuit 32. Both the serial link data input interface SDIP and the serial link data output interface SDOP have the data transmission of the bidirectional single-end serial link. The microcontroller unit MCU can transmit commands and write data to the calibration matrix processing unit 31.

Please note that this embodiment may function as shifting the bin level (i.e., adjusting the light-emitting interval of the LED lamp bead 10*b*). As listed in the following Table 1, the lamp bead has the original bin level. When the user needs to adjust the original bin level to the new bin level (e.g., adjust the group of S3 bin level to the group of R3 bin level), the calibration matrix processing unit 31 receives the new calibration parameter matrix, and performs matrix multiplication of the grayscale vector and the new calibration parameter matrix to generate a second new grayscale vector because the light-emitting intensity of the LED lamp bead 10*b* needs to be adjusted.

TABLE 1 brightness intensities corresponding to bin levels

| Group | Minimum (micro-candela) | Maximum (micro-candela) |
|---|---|---|
| R3 | 100 | 140 |
| S3 | 140 | 200 |
| T3 | 200 | 285 |
| U3 | 285 | 400 |
| V3 | 400 | 560 |

When the brightness of the LED lamp bead 10*b* corresponding to the second new grayscale vector satisfies the corresponding new bin level, the nonvolatile memory stores all matrix elements of the calibration parameter matrix corresponding to the LED lamp bead 10*b* as the calibratable parameter.

The above-mentioned calibratable parameter includes: a RGB grayscale component corresponding to the LED lamp bead 10*b*, or a RGB grayscale component and the appropriate current value vector of RGB (i.e., each of colors of grayscale components (e.g., the red lamp bead R, the green lamp bead G and the blue lamp bead B) and the corresponding appropriate current value vectors.

Figure 4:
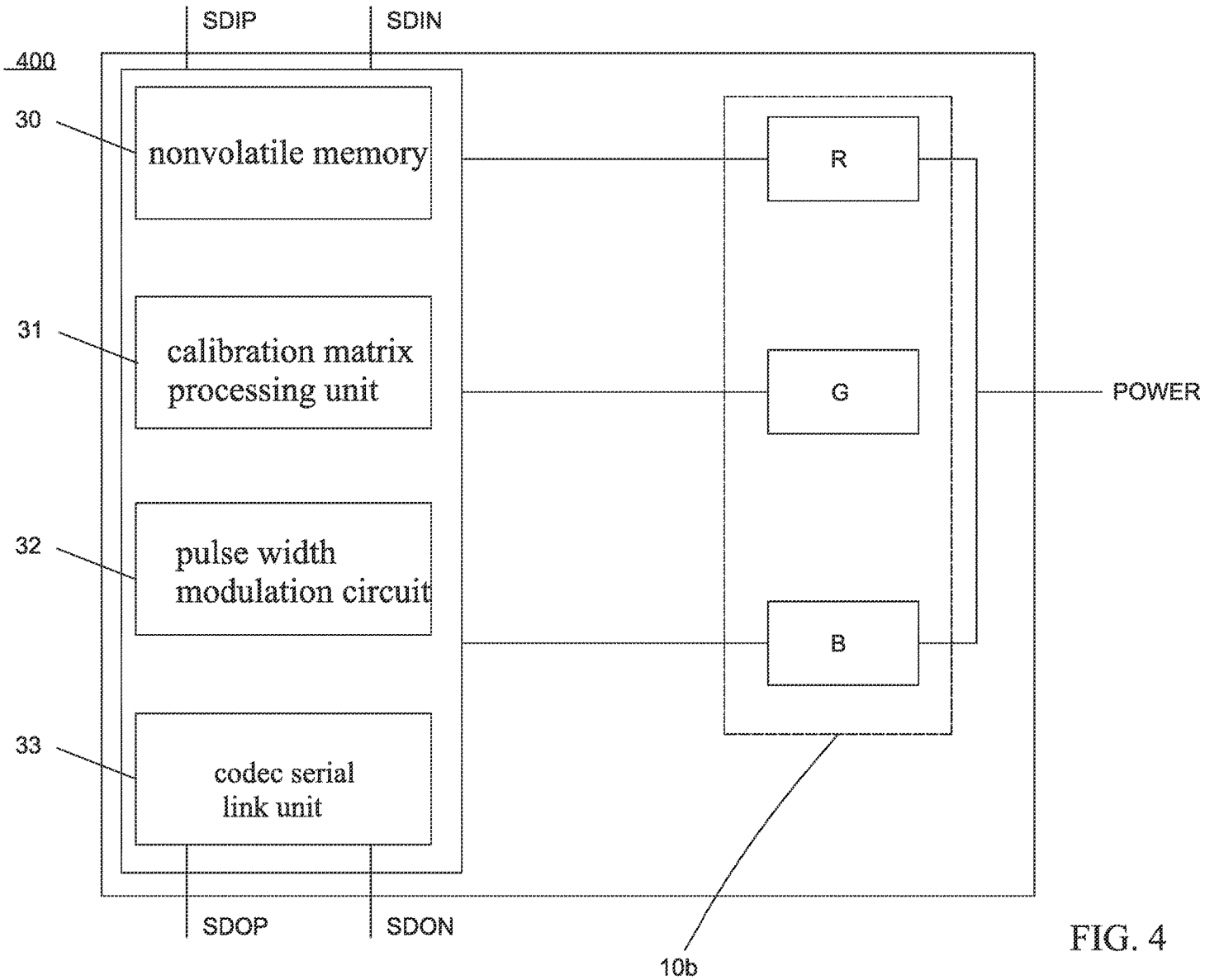
FIG. 4 is a schematic view showing a serial LED driver according to an embodiment of this disclosure.

FIG. 4 is a schematic view showing a serial LED driver 400 according to an embodiment of this disclosure. Referring to FIG. 4, the difference between the serial LED drivers 400 and 300 resides in that the serial link data input interfaces SDIP and SDIN and the serial link data output interfaces SDOP and SDON have the data transmission of the bidirectional differential serial link. The microcontroller unit MCU transmits the grayscale vector, the calibration parameter matrix or the appropriate current value vector through a differential signal. Each of the serial link data input interfaces SDIP and SDIN and the serial link data output interfaces SDOP and SDON is implemented by a Manchester codec.

The differential serial link of this embodiment can decrease the affect of the common mode noise, and further decrease the noise emission. So, when the two neighboring lines of the differential combination is transmitting the data, the current will flow equally to both sides, so that the equal, opposite and mutually offset electromagnetic fields are generated.

In addition, the differential serial link of this embodiment can provide the higher data rate, so that the serial transmission of a series of more serial drivers can be performed through one single channel.

Figure 5:
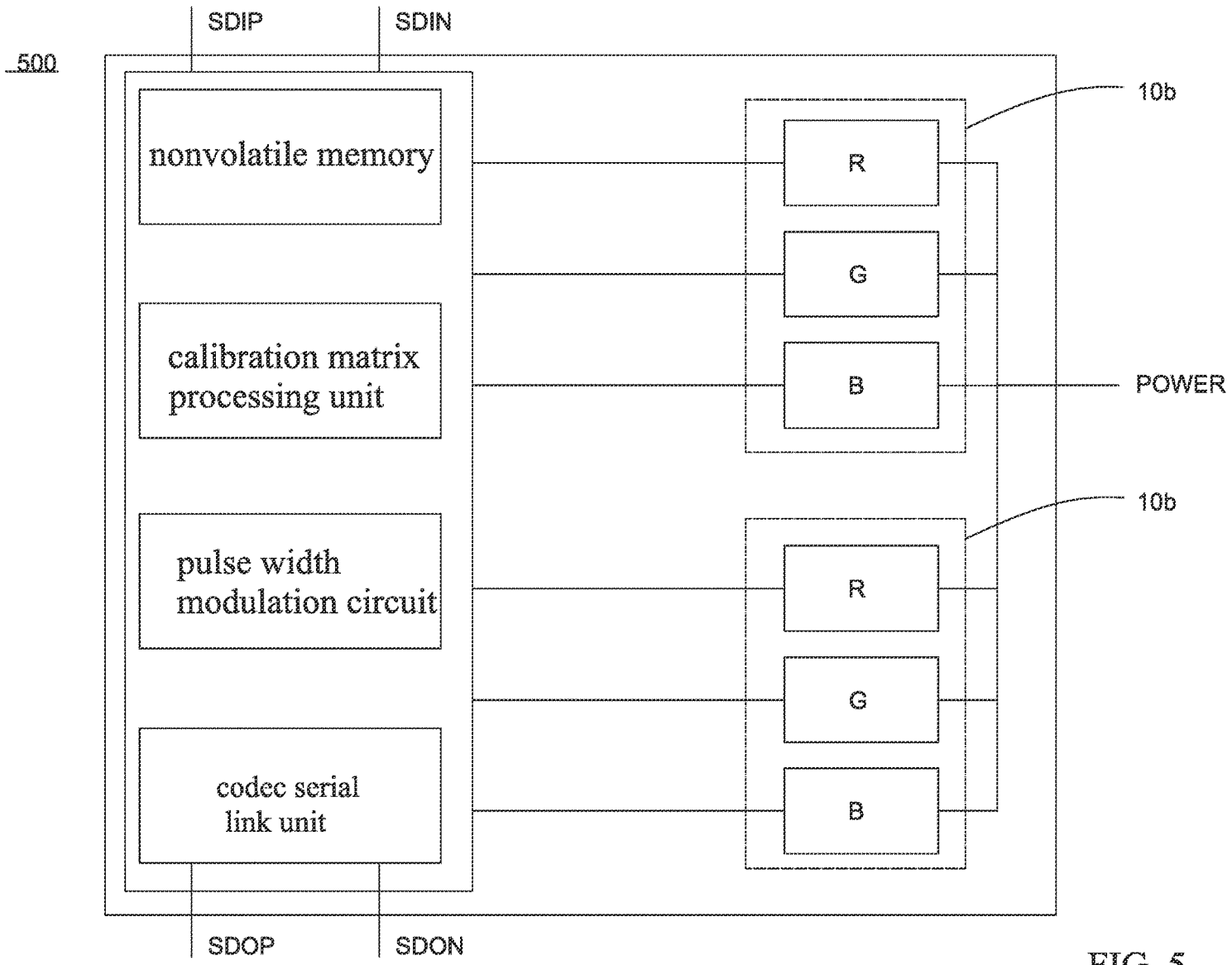
FIG. 5 is a schematic view showing a serial LED driver according to an embodiment of this disclosure.

FIG. 5 is a schematic view showing a serial LED driver 500 according to an embodiment of this disclosure. Referring to FIG. 5, the difference between the serial LED drivers 500 and 400 resides in that the serial LED driver 500 has the architecture of two pixels of lamp beads 10*b*. That is, each serial LED driver 500 may include multiple pixels of lamp beads 10*b*.

Figure 6:
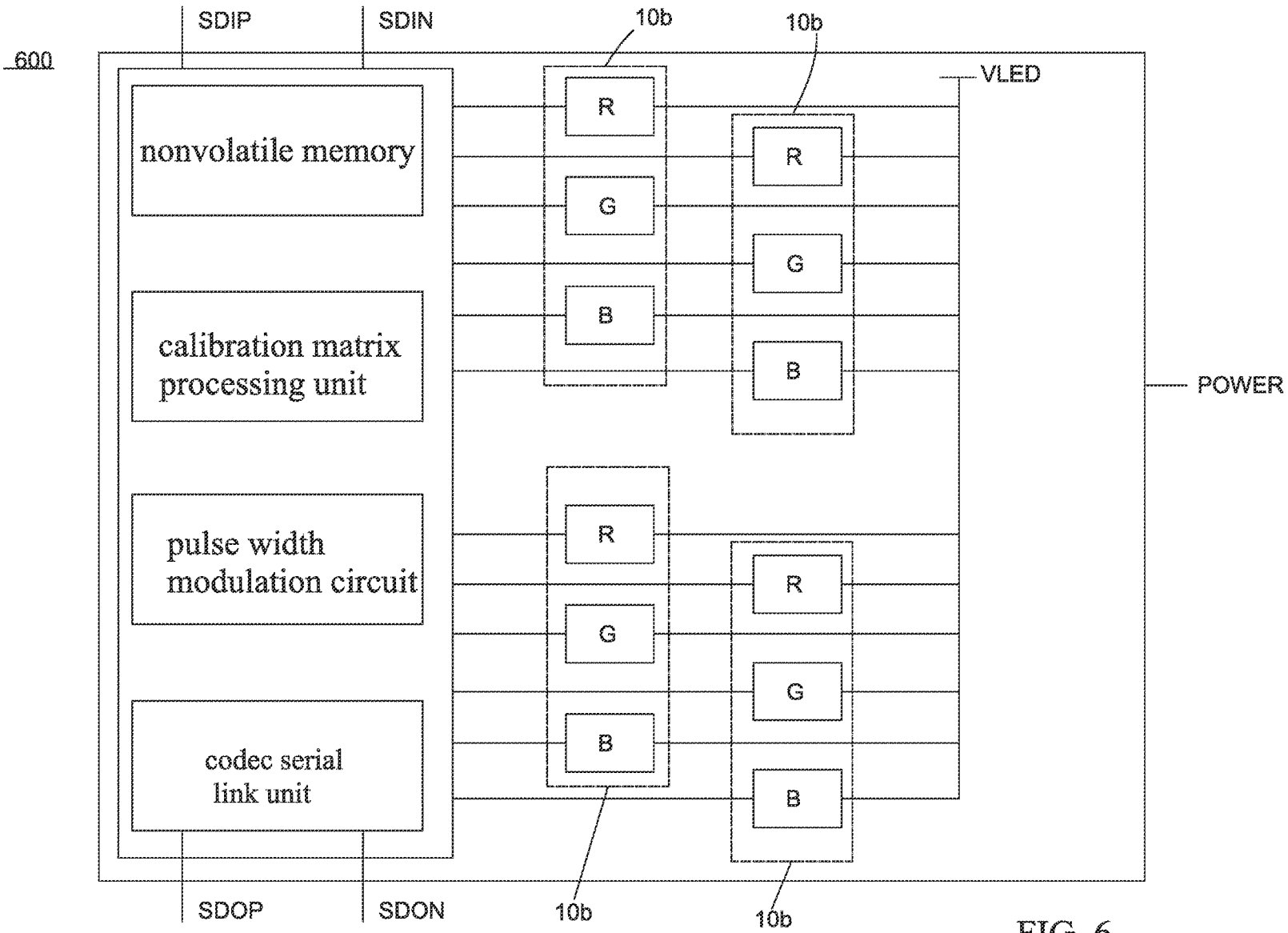
FIG. 6 is a schematic view showing a serial LED driver according to an embodiment of this disclosure.

FIG. 6 is a schematic view showing a serial LED driver 600 according to an embodiment of this disclosure. Referring to FIG. 6, the difference between the serial LED drivers 600 and 500 resides in that the serial LED driver 600 has the architecture of four pixels of lamp beads 10*b*, wherein the voltage VLED represents the forward voltage.

Figure 7:
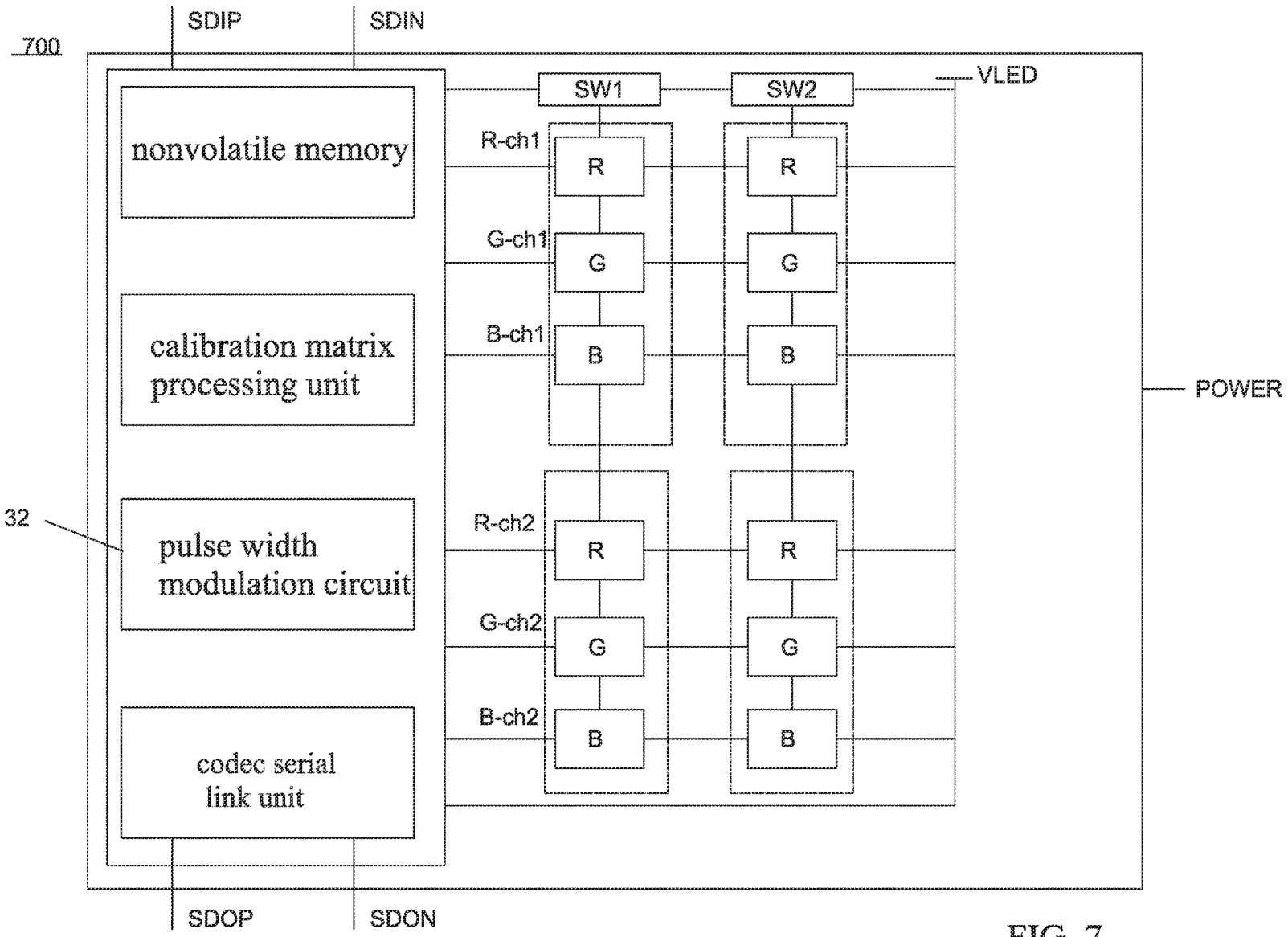
FIG. 7 is a schematic view showing a serial LED driver according to an embodiment of this disclosure.

FIG. 7 is a schematic view showing a serial LED driver 700 according to an embodiment of this disclosure. Referring to FIG. 7, the difference between the serial LED drivers 700 and 600 resides in that the serial LED driver 700 has built-in time-sharing power switching units SW1 and SW2, which may function for driving and discharging. That is, the time-sharing power switching unit SW1 or SW2 can be turned on or off to drive and discharge the lamp beads 10*b*. So, the pulse width modulation circuit 32 generates the constant currents R-ch1, G-ch1, B-ch1, R-ch2, G-ch2 and B-ch2 corresponding to each of the red lamp bead R, the green lamp bead G, and the blue lamp bead B at different time instants to drive or discharge each of the red lamp bead R, the green lamp bead G, the blue lamp bead B at different time instants. The other calibration theorem has been mentioned previously, and detailed descriptions thereof will be omitted here.

In summary, this disclosure can perform the computation according to the input grayscale vector, received by the LED driver, and the calibratable parameter stored in the nonvolatile memory so that the color of the LED lamp bead reaches the more precisely predefined value; or the light-emitting range of the LED lamp bead can be selectively shifted to decrease the inventory requirements of different bin levels of LED lamp beads.

What is claimed is:

1. A serial LED driver with a built-in calibratable parameter, the serial LED driver transmitting a grayscale vector, a calibration parameter matrix or an appropriate current value vector, the serial LED driver comprising:

a nonvolatile memory receiving and storing the calibratable parameter corresponding to a LED lamp bead, the calibratable parameter is utilized for calibration of the LED lamp bead;

a calibration matrix processing unit, which reads elements of the calibration parameter matrix corresponding to the LED lamp bead and being pre-stored in the nonvolatile memory, receives the grayscale vector, and performs matrix computation according to the grayscale vector and the calibration parameter matrix to generate a first new grayscale vector; and a pulse width modulation circuit, which outputs a constant current to the LED lamp bead according to the first new grayscale vector to adjust the LED lamp bead; or outputs another corresponding constant current to the LED lamp bead to adjust the LED lamp bead according to the first new grayscale vector and the appropriate current value vector corresponding to the LED lamp bead and being pre-stored in the nonvolatile memory;

wherein, when the error of the color precision of the LED lamp bead is smaller than ±2%, the calibration matrix processing unit stops the computation of pre-calibrating the grayscale vector and the calibration parameter matrix; at this time, the nonvolatile memory stores all matrix elements of the calibration parameter matrix corresponding to the LED lamp bead as the calibratable parameter.

2. The serial LED driver according to claim 1, wherein the LED lamp bead has a corresponding bin level, wherein when an original bin level is adjusted to a new bin level, the calibration matrix processing unit receives a new calibration parameter matrix, and the calibration matrix processing unit performs matrix multiplication of the grayscale vector and the new calibration parameter matrix to generate a second new grayscale vector.

3. The serial LED driver according to claim 2, wherein when a brightness of the LED lamp bead corresponding to the second new grayscale vector satisfies the corresponding new bin level, the nonvolatile memory stores the calibratable parameter of the LED lamp bead corresponding to the bin level.

4. The serial LED driver according to claim 1, wherein when an error of brightness precision of the LED lamp bead is lower than a predetermined value, the nonvolatile memory stores the LED lamp bead corresponding the calibratable parameter.

5. The serial LED driver according to claim 1, further comprising:

a codec serial link unit, which encodes the grayscale vector, the calibration parameter matrix or the appropriate current value vector into encoded data transmitted to another serial LED driver, or decodes encoded data, received from another serial LED driver, into the grayscale vector or the calibration parameter matrix transmitted to the calibration matrix processing unit, or into the appropriate current value vector transmitted to the pulse width modulation circuit.

6. The serial LED driver according to claim 1, wherein the calibratable parameter comprises: a RGB grayscale component corresponding to the LED lamp bead; or a RGB grayscale component corresponding to the LED lamp bead and the appropriate current value vector of RGB.

7. A LED display system, comprising:

a microcontroller unit transmitting a grayscale vector, a calibration parameter matrix or an appropriate current value vector;

multiple serial LED drivers arranged in an array, wherein each of the serial LED drivers comprises;

a LED lamp bead;

a nonvolatile memory receiving and storing a calibratable parameter corresponding to the LED lamp bead, wherein the calibratable parameter is utilized for calibration of the LED lamp bead;

a calibration matrix processing unit, which reads elements of the calibration parameter matrix corresponding to the LED lamp bead and being pre-stored in the nonvolatile memory, receives the grayscale vector, and performs matrix computation according to the grayscale vector and the calibration parameter matrix to generate a first new grayscale vector; and a pulse width modulation circuit, which outputs a constant current to the LED lamp bead according to the first new grayscale vector to adjust the LED lamp bead; or the pulse width modulation circuit according to the first new grayscale vector and the appropriate current value vector corresponding to the LED lamp bead and being pre-stored in the nonvolatile memory, outputs another corresponding constant current to the LED lamp bead to adjust the LED lamp bead;

wherein, when the error of the color precision of the LED lamp bead is smaller than ±2%, the calibration matrix processing unit stops the computation of pre-calibrating the grayscale vector and the calibration parameter matrix; at this time, the nonvolatile memory stores all matrix elements of the calibration parameter matrix corresponding to the LED lamp bead as the calibratable parameter.

8. The LED display system according to claim 7, wherein the LED lamp bead has a corresponding bin level, wherein when an original bin level is adjusted to a new bin level, the calibration matrix processing unit receives a new calibration parameter matrix, and the calibration matrix processing unit performs matrix multiplication of the grayscale vector and the new calibration parameter matrix to generate a second new grayscale vector.

9. The LED display system according to claim 8, wherein when a brightness of the LED lamp bead corresponding to the second new grayscale vector satisfies the corresponding new bin level, the nonvolatile memory stores the LED lamp bead corresponding the calibratable parameter.

10. The LED display system according to claim 7, wherein when an error of brightness precision of the LED lamp bead is lower than a predetermined value, the nonvolatile memory stores the LED lamp bead corresponding the calibratable parameter.

11. The LED display system according to claim 7, wherein the serial LED driver further comprises:

a codec serial link unit, which decodes the grayscale vector, the calibration parameter matrix or the appropriate current value vector into encoded data transmitted to another serial LED driver; or decodes encoded data, received from another serial LED driver, into the grayscale vector or the calibration parameter matrix transmitted to the calibration matrix processing unit, or into the appropriate current value vector transmitted to the pulse width modulation circuit.

12. The LED display system according to claim 7, wherein the calibratable parameter comprises: a RGB grayscale component corresponding to the LED lamp bead; or a RGB grayscale component corresponding to the LED lamp bead and the appropriate current value vector of RGB.

13. A serial LED driver with a built-in calibratable parameter, the serial LED driver transmitting a grayscale vector, a calibration parameter matrix or an appropriate current value vector, the serial LED driver comprising:

a nonvolatile memory receiving and storing the calibratable parameter corresponding to a LED lamp bead, the calibratable parameter is utilized for calibration of the LED lamp bead;

a calibration matrix processing unit, which reads elements of the calibration parameter matrix corresponding to the LED lamp bead and being pre-stored in the nonvolatile memory, receives the grayscale vector, and performs matrix computation according to the grayscale vector and the calibration parameter matrix to generate a first new grayscale vector; and a pulse width modulation circuit, which outputs a constant current to the LED lamp bead according to the first new grayscale vector to adjust the LED lamp bead; or outputs another corresponding constant current to the LED lamp bead to adjust the LED lamp bead according to the first new grayscale vector and the appropriate current value vector corresponding to the LED lamp bead and being pre-stored in the nonvolatile memory;

wherein, when an original bin level is adjusted to a new bin level, the calibration matrix processing unit receives a new calibration parameter matrix, and the calibration matrix processing unit performs matrix multiplication of the grayscale vector and the new calibration parameter matrix to generate a second new grayscale vector.

* * * * *